United States Patent [19]

Saka

[11] 4,456,284

[45] Jun. 26, 1984

[54] CONVERTIBLE SKIER SEAT AND SKI CARRIER

[76] Inventor: James Y. Saka, 2470 Adriatic Ave., Long Beach, Calif. 90810

[21] Appl. No.: 461,595

[22] Filed: Jan. 27, 1983

[51] Int. Cl.[3] ..... A63C 11/02

[52] U.S. Cl. ..... 280/812; 224/917; 280/814; 294/147; 297/129

[58] Field of Search ..... 280/812, 814, 816; 294/141, 147; 224/917, 151, 155; 135/65, 66; 297/129

[56] References Cited

U.S. PATENT DOCUMENTS

| | | | |
|---|---|---|---|
| 384,790 | 6/1888 | Schiff | 135/65 |
| 2,118,875 | 5/1938 | Windheim | 294/147 |
| 2,224,568 | 12/1940 | Altorfer | 224/155 |
| 2,257,831 | 10/1941 | Wood | 280/812 |
| 2,530,695 | 11/1950 | Helmert | 280/812 |
| 3,874,687 | 4/1975 | Cadwalader | 280/812 |
| 3,902,731 | 9/1975 | Fagen | 280/812 |
| 3,920,166 | 11/1975 | Hogensen, Jr. | 294/147 |
| 4,065,140 | 12/1977 | Cadwalader | 280/812 |
| 4,131,289 | 12/1978 | Maller | 224/917 |

FOREIGN PATENT DOCUMENTS

| | | | |
|---|---|---|---|
| 2265424 | 10/1975 | France | 280/814 |
| 7906337 | 2/1981 | Netherlands | 280/814 |

*Primary Examiner*—David M. Mitchell

*Attorney, Agent, or Firm*—Fulwider, Patton, Rieber, Lee & Utecht

[57] ABSTRACT

A support strap convertible from a skier seat to a ski carrier and vice versa, the strap comprising pockets at the ends of the strap for receiving a pair of ski pole handles whereby the strap is adapted to be suspended between generally upright ski poles to define a skier seat. The pockets include ski straps adapted to define loops into which the hands of the skier in the skier seat can be inserted for stability. The support strap is capable of use as a ski carrier by disposition of the ski straps about a pair of skis to hold them together in parallel, unitary relationship, with one of the ski straps in engagement with at least a portion of the ski bindings. The support strap defines a loop which can be slung over the shoulder of the skier. The support strap includes additional structural elements enabling a pair of ski poles to be carried along with the skis, and further includes other structural elements facilitating attachment of the folded up, collapsed support strap in an unobtrusive package on a belt or strap of the skier's clothing.

9 Claims, 5 Drawing Figures

FIG. 1
FIG. 2
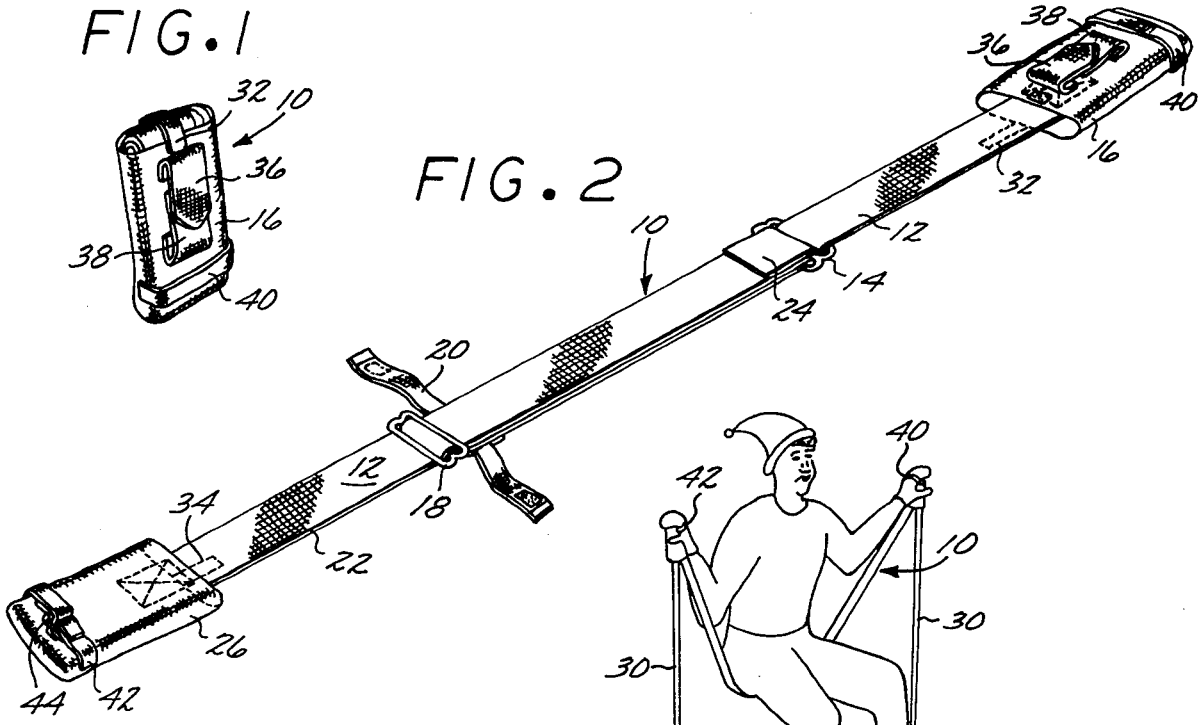
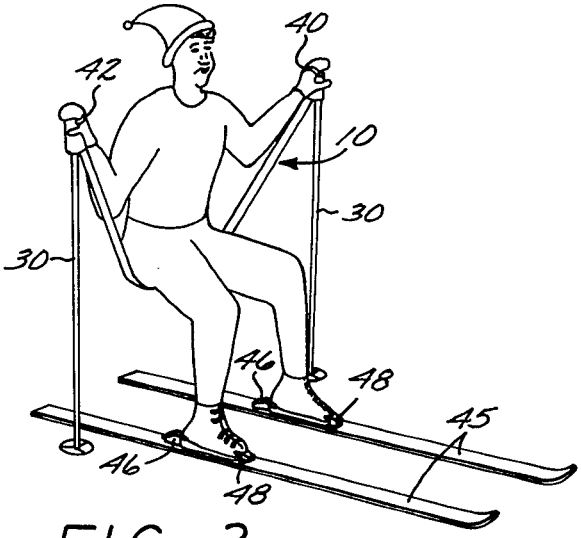
FIG. 3
FIG. 4
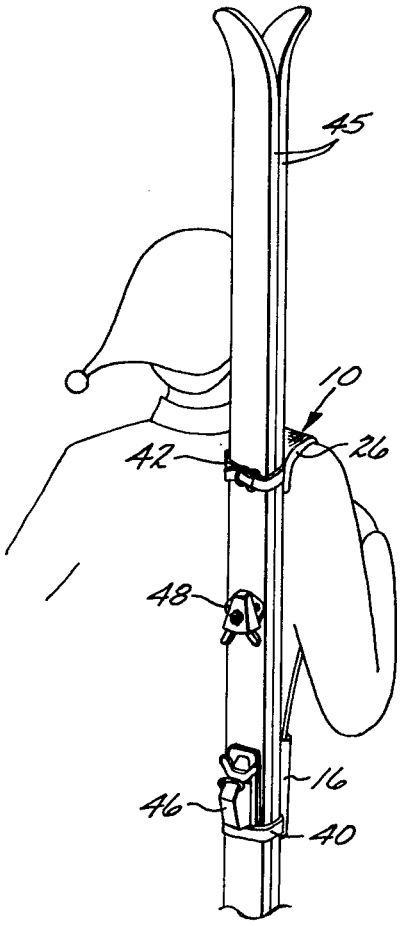
FIG. 5
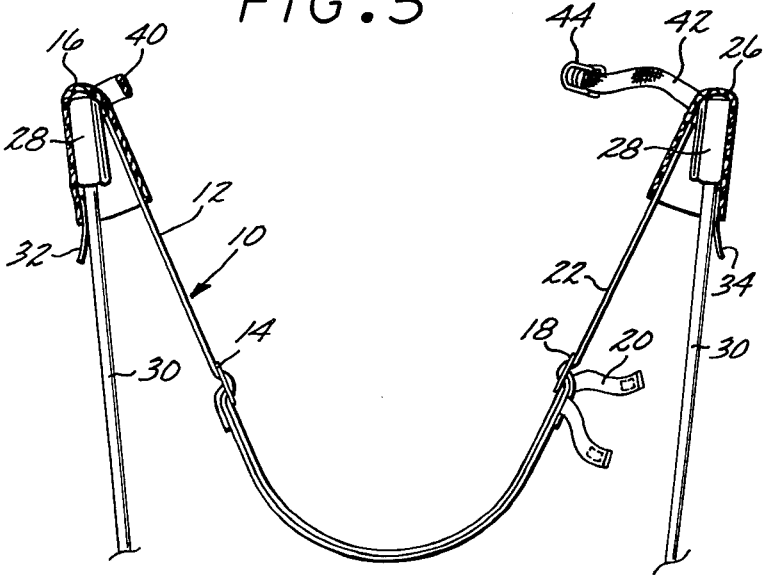

CONVERTIBLE SKIER SEAT AND SKI CARRIER

BACKGROUND OF THE INVENTION

1. Field of the Invention:

The present invention relates to a support strap of the type which is mountable on a pair of ski poles to provide a skier seat, and which is convertible into a ski carrier by disposition of the opposite ends of the support strap in spaced relation along the length of a pair of skis disposed together in parallel, unitary relationship.

2 Description of the Prior Art:

U.S. Pat. Nos. 2,530,695 and 3,920,166 are representative of devices of the prior art which provide a strap device convertible from a waist belt to a ski carrier and vice versa. These devices suffer the disadvantage that the ski carrier becomes a conspicuous waist belt when it is not in use. Further, the device is not capable of being arranged to serve as a skier seat.

U.S. Pat. Nos. 2,257,831; 3,874,687; and 4,065,140 are representative of strap or strap and cord devices which include end pockets for receiving ski pole handles whereby the device can be suspended between generally upright ski poles for use as a skier seat. However, none of these devices is capable of being used to carry a skier's skis and poles.

SUMMARY OF THE INVENTION

According to the present invention, a support strap is provided which is convertible from a skier seat to a ski carrier and vice versa. The support strap includes elongated strap means having pockets attached to its opposite extremities for receiving a pair of ski pole handles whereby the strap means is adapted to be suspended between generally upright ski poles to define the skier seat. The pockets include ski straps, respectively, which are adapted to define loops into which the hands of the skier can be inserted for stability when the device is being used as a ski seat. The support strap is easily convertible to a ski carrier by removing the ski pole handles from the pockets and disposing the ski straps in spaced relation about a pair of parallel skis arranged in unitary relation, with one of the straps engaging the ski bindings. The loop of the ski strap can be slung over the shoulder of the skier to raise and support the skis.

In one embodment of the invention the support strap includes a transverse ski pole strap. When the support strap is being used a a ski carrier, the ski pole strap can be disposed about the ski poles to carry them along with the skies.

Other features of the support strap facilitate folding up and collapse of the strap into a compact package for attachment to a belt or clothing strap of the skier.

Other objects and features of the invention will become apparent from consideration of the following description taken in connection with the accompanying drawings.

BRIEF DESCRIPTION OF THE DRAWING

FIG. 1 is a perspective view of the present support strap in its folded up, collapsed state preparatory to attachment to a belt or strap of the skier's clothing;

FIG. 2 is a perpsective view of the unfolded ski strap of FIG. 1;

FIG. 3 is a perspective view of the support strap being used as a skier seat;

FIG. 4 is a perspective view of the support strap being used as a ski carrier; and FIG. 5 is a front elevational view, partly in section, illustrating the manner in which the pockets of the support strap are fitted over the handles of a pair of generally upright ski poles.

DESCRIPTION OF THE PREFERRED EMBODIMENT

Referring now to the drawings, there is illustrated a support strap 10 which is convertible from the skier seat of FIG. 3 to the ski carrier of FIG. 4. The suport strap 10 comprises, generally, elongated strap means which include an elongated band or strap 12 which extends first through one and then the other of a pair of adjacent and parallel elongated openings in a buckle or length adjustment slide 14. One end of the strap 12 is sewn or otherwise attached to a pocket 16 made of flexible cloth or fabric. The opposite end of the strap 12 extends through one and then the other of a pair of adjacent and parallel elongated openings in a second buckle or length adjustment slide 18, the end if the strap 12 being reversely formed and sewn or otherwise attached upon itself to define a loop 20 through which is dispsed a transversely oriented ski pole strap 20.

For purposes which will be described, the opposite extremities of the pole strap 20 are adapted to be secured togehter. Although clips ties, or the like could be utilized, it is preferred to use a fastener material known in the trade as "Velcro" material. As is well known, Velcro material comprises a section or patch of burr-like material adapted to project into and snag or attach to a patch of material characteized by fibrous loops, a path of each of these materials being sewn or otherwise attached to complemental extremities of the pole strap 20 so that the extremities will adhere upon being pressed together. For convenience these patches affording such an attachment as "Velcro" patches are sometimes referred to in this disclosure.

The strap 10 also includes a second elongated band or strap 22, identical to the strap 12, and extending first through the openings of the slide 18 and then through the openings of the slide 14, being doubled back or reversely formed and sewn or otherwise attached to itself to define a loop 24. The opposite extremity of the strap 22 is sewn or otherwise attached to a pocket 26 identical to the pocket 16.

With this arrangement, the straps 12 and 22 can be manipulated relative to the slides 14 and 18 to adjust the length of the overall support strap 10, as will be apparent.

The straps 12 and 22 are preferably made of a strong woven synthetic fiber material adapted to withstand high tensile forces. However, any material can be used which is flexible, so that it can be rolled up, folded or otherwise collapsed into a small package, and yet which is adapted to bear the weight of a skier.

When the support strap 10 is to be used as a skier seat, the pockets 16 and 26 are fitted over the usual ski pole handles 28 of a pair of ski poles 30 whose opposite or tip ends are forcibly driven into the snow to orient the poles 30 in a generally upright position, as seen in FIGS. 3 and 5. Preferably a pair of elongated pole tabs 32 and 34 are attached to the pockets 16 and 26, respectively, adjacent their open ends whereby the tabs 32 and 34 can be grasped by the mittened or gloved skier to facilitate secure seating of the pockets 16 and 26 upon the ski pole handles 28.

The pole tab 32 can be provided with an attachment means, such as a Velcro patch (not shown) so that when the support strap 10 is rolled up, folded, or otherwise collapsed and fitted within the pocket 26, the pole tab 32 can be pulled across the open end of the pocket 16 in overlying relation to the compacted strap 10 in the pocket 26, and pressed against a complemental Velcro patch (not shown) attached to the adjacent face of the pocket 26, thereby preventing the contents of the pocket 26 from being inadvertently released.

In this regard, the outer face of the pocket 16 may be provided with a pair of elongated elements 36 and 38 adapted to encircle a belt or clothing strap (not shown) of the skier for conveniently attaching the collapsed support strap 10 in an unobtrusive package. The ends of the elements 36 and 38 are sewn or otherwise attached to the face of the pocket 16 in spaced relation, and their opposite, adjoining ends are provided with a suitable fastening means, such as a pair of Velcro patches (not shown) whereby they can be quickly and easily connected and disconnected.

Although only the pocket 16 may be made sufficiently large to receive the collapsed, folded up support strap 10, both pockets 16 and 26 can be made of the same size for manufacturing convenience.

A unique feature of the present invention is the provision of a pair of ski straps 40 and 42 which are sewn or otherwise attached adjacent the closed extremities of the pockets 16 and 26. Both straps 40 and 42 are adapted to define loops into which the hands of a skier can be inserted when the skier is using the support strap 10 as a skier seat, as seen in FIG. 3 The disposition of the hands through the straps 40 and 42 promotes skier stability and also facilitates quick removal of the pockets 16 and 26 from the ski pole handles 28 when the skier wishes to resume skiing.

Preferably the strap 40 is a closed loop, while the strap 42 is made in two sections, one of which mounts a pair of usual and conventional D-rings 44 which are useful when the support strap 10 is used as a ski carrier, as will be seen.

When the support strap 10 is to be converted from the skier seat of FIG. 3 to the ski carrier of FIG. 4, the pockets 16 and 26 are pulled off the ski pole handles 28, and the closed loop ski strap 40 is slipped over the lower ends of a pair of skis 45, which are held in parallel engaged relationship in a unitary bundle or package. The closed loop ski strap is slid upwardly until it engages the heel portions 46 of the ski bindings.

The open loop ski strap 42 is next disposed about the skis 45 in spaced relation to the lower ski strap 40, preferably above the toe portions 48 of the ski bindings, as best in FIG. 4. The open loop ski strap 42 is then securely clamped onto the skis 45 by use of the D-rings 44, and the intermediated or bight portion of the straps 12 and 22 defines a loop which can be fitted upon or slung over the skier's shoulder for carriage of the skis 45 in a generally upright position. In this position of the support strap 10, the pair of ski poles 30 can be arranged against the forwardly face portion of the support strap 10 in position where the ski pole strap 20 can be disposed about the poles 30. Attachment of the free ends of the pole strap 20 by the Velcro patches then securely holds the ski poles 30 in upright position adjacent the skis 45.

With the foregoing arrangement it is a simple matter for a tired skier to remove the folded up support strap illustrated in FIG. 1 from the containing pocket 26, and thereafter fit the pockets 16 and 26 in position upon the ski poles 30, as seen in FIG. 3. On the other hand, if the skier wants to carry the skis 45, it is an equally simple matter to arrange the ski straps 40 and 42 as shown in FIG. 4 to enable the skis 45 to be carried at the shoulder. Of particular importance is the fact that the support strap 10 can be so compactly collapsed or folded up that it can be carried in an unobstrusive package attachable to the skier's clothing.

Various modifications and changes may be made with regard to the foregoing detailed description without departing from the spirit of the invention.

I claim:

1. A support strap convertible from a skier seat to a ski carrier and vice versa, said support strap comprising:

elongated strap means;

first and second pockets attached to the opposite extremities of said strap means for receiving a pair of ski pole handles, respectively, whereby said strap means is adapted to be suspended between generally upright ski poles to define a skier seat; and first and second ski straps attached to said first and second pockets, respectively, and adapted to define loops into which the hands of a skier in said ski seat can be inserted for stability, said support strap being capable of use as a ski carrier by separating said pockets from said ski pole handles, and disposing said first ski strap about a pair of skis in engagement with at least a portion of the ski bindings thereof, and disposing said second ski strap about both skis above said first ski strap to define a loop to fit over the shoulder of the skier.

2. A support strap according to claim 1 wherein said first pocket is sufficiently large to receive the collapsed, folded up remainder of said support strap, including said second pocket, said strap means, and said first and second ski straps.

3. A support strap according to claim 2 including a pair of elongated elements carried by an outer face of said first pocket, said elongated elements being adapted to encircle a belt or clothing strap of the skier and attach together to hold said first pocket and the remainder of said support strap contained therein upon said belt or clothing strap.

4. A support strap according to claim 1 wherein said first ski strap defines a closed loop, and said second ski strap comprises a pair of strap portions whose free ends include means for attaching together said free ends subsequent their disposition about said skis.

5. A support strap according to claim 1 including first and second elongated pull tabs attached adjacent the open ends of said first and second pockets, respectively, and adapted to be grasped by the skier to firmly seat said pockets onto said pair of ski pole handles.

6. A support strap according to claim 2, and including first and second elongated pull tabs attached adjacent the open ends of said first and second pockets, respectively, and adapted to be grasped by the skier to firmly seat said pockets onto said pair of ski pole handles, said first pull tab being adapted to extend across the open end of said first pocket adjacent a face thereof and including means upon its free end adapted to attach to said face to constrain the collapsed, folded up portions of said support strap within said first pocket from coming out of said first pocket.

7. A support strap according to claim 1 wherein said strap means includes a transversely oriented ski pole strap between the opposite extremities of said strap means, said ski pole strap including attachment means at its opposite extremities for attaching said ski pole strap about a pair of ski poles to support said ski poles upon said loop fitted over said shoulder of said skier.

8. A support strap according to claim 1 wherein said strap means includes length adjustment means for adjusting the length of said strap means.

9. A support strap according to claim 1 wherein said first ski strap defines a closed loop adapted to be slid onto said skis below the heel portions of said ski bindings for engagement therewith, and said second ski strap defines an open loop and includes end attachments for attachment of the free ends of said second ski strap about said skis above the toe portions of said ski bindings.

* * * * *